US009858853B2

(12) United States Patent
Giannikouris et al.

(10) Patent No.: US 9,858,853 B2
(45) Date of Patent: Jan. 2, 2018

(54) OLED DISPLAY SYSTEM AND METHOD

(71) Applicant: Ignis Innovation Inc, Waterloo (CA)

(72) Inventors: Allyson Giannikouris, Kitchener (CA); Jaimal Soni, Waterloo (CA); Nino Zahirovic, Waterloo (CA); Ricky Yik Hei Ngan, Richmond Hills (CA); Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

(21) Appl. No.: 15/652,481

(22) Filed: Jul. 18, 2017

(65) Prior Publication Data

US 2017/0316729 A1 Nov. 2, 2017

Related U.S. Application Data

(63) Continuation of application No. 14/561,404, filed on Dec. 5, 2014, now Pat. No. 9,741,282.

(60) Provisional application No. 61/976,909, filed on Apr. 8, 2014, provisional application No. 61/912,786, filed on Dec. 6, 2013.

(51) Int. Cl.

| | |
|---|---|
| ***G09G 3/20*** | (2006.01) |
| ***G09G 3/3208*** | (2016.01) |
| ***G09G 3/3233*** | (2016.01) |

(52) U.S. Cl.

CPC ..... *G09G 3/2074* (2013.01); *G09G 3/2003* (2013.01); *G09G 3/3208* (2013.01); *G09G 3/3233* (2013.01); *G09G 2300/0452* (2013.01); *G09G 2300/0852* (2013.01); *G09G 2320/0238* (2013.01); *G09G 2320/0276* (2013.01); *G09G 2320/0673* (2013.01); *G09G 2330/021* (2013.01); *G09G 2340/06* (2013.01)

(58) Field of Classification Search

CPC ..... G09G 3/3208; G09G 3/2003; G09G 2320/0238; G09G 2320/0276; G09G 2300/0452

See application file for complete search history.

(56) References Cited

U.S. PATENT DOCUMENTS

| | | | | |
|---|---|---|---|---|
| 2003/0128225 | A1* | 7/2003 | Credelle | G02F 1/133514 345/694 |
| 2004/0239595 | A1* | 12/2004 | Vulto | G09G 3/3208 345/76 |
| 2006/0284872 | A1* | 12/2006 | Brown Elliott | H04N 1/56 345/426 |
| 2010/0315449 | A1* | 12/2010 | Chaji | G09G 3/3208 345/690 |
| 2011/0069094 | A1* | 3/2011 | Knapp | G09G 3/2003 345/690 |

* cited by examiner

*Primary Examiner* — Shaheda Abdin
(74) *Attorney, Agent, or Firm* — Nixon Peabody LLP

(57) ABSTRACT

A method and system control an OLED display to achieve desired color points and brightness levels in an array of pixels in which each pixel includes at least three sub-pixels having different colors and at least one white sub-pixel. The method and system select a plurality of reference points in the pixel content domain with known color points and brightness levels. For each set of three sub-pixels of different colors, the method and system determine the share of each sub-pixel to produce the color point and brightness level of each selected reference point, and select the maximum share determined for each sub-pixel as peak brightness needed from that sub-pixel.

23 Claims, 7 Drawing Sheets

OLED DISPLAY SYSTEM AND METHOD

CROSS REFERENCE TO RELATED APPLICATIONS

This application is a continuation of U.S. patent application Ser. No. 14/561,404, filed Dec. 5, 2014, now allowed, which claims the benefit of U.S. Provisional Patent Applications Nos. 61/976,909, filed Apr. 8, 2014, and 61/912,786, filed Dec. 6, 2013, each of which is hereby incorporated by reference in its entirety.

FIELD OF THE INVENTION

The present invention relates generally to OLED displays and, more particularly, to an OLED display system and method for improving color accuracy, power consumption or lifetime, and gamma and black level correction of OLED displays that have three or more sub-pixel of different colors and at least one white sub-pixel.

SUMMARY

In accordance with one embodiment, a method and system are provided for controlling an OLED display to achieve desired color points and brightness levels in an array of pixels in which each pixel includes at least three sub-pixels having different colors and at least one white sub-pixel. The method and system select a plurality of reference points in the pixel content domain with known color points and brightness levels. For each set of three sub-pixels of different colors, the method and system determine the share of each sub-pixel to produce the color point and brightness level of each selected reference point, and select the maximum share determined for each sub-pixel as the peak brightness needed from that sub-pixel.

In accordance with another embodiment, the method and system identify tri-color sets of three sub-pixels of different colors that encircle a desired color point, and, for each identified tri-color set of sub-pixels, determine the brightness shares of the sub-pixels in that tricolor set to produce the desired color point. The method and system select a set of share factors based on at least a pixel operation point and display performance, modify the brightness shares based on the share factors, and map the modified brightness shares to pixel input data. In one implementation, The method and system determine the efficiencies of the identified tri-color sets, increase the share factor of the tri-color set with the highest efficiency; decrease the share factor of the tri-color set with the lowest efficiency, as the gray scale of the desired color point increases, and decrease the share factor of the tri-color set with the highest efficiency, and increase the share factor of the tri-color set with the lowest efficiency, as the gray scale of the desired color point decreases.

A further embodiment provides an OLED display comprising an array of pixels in which each pixel includes at least three sub-pixels having different colors and at least one white sub-pixel for displaying desired color points and brightness levels. Each pixel includes at least three sub-pixels having different colors and at least one white sub-pixel, the sub-pixels having operating conditions that vary with the gray level displayed by the sub-pixel. The pixel has at least two sub-pixels for displaying the same color but having operating conditions that vary differently with the gray level being displayed. A controller selects one of the two sub-pixels displaying the same color, in response to a gray level input to that pixel.

BRIEF DESCRIPTION OF THE DRAWINGS

The foregoing and other advantages of the invention will become apparent upon reading the following detailed description and upon reference to the drawings.

Figure 1:
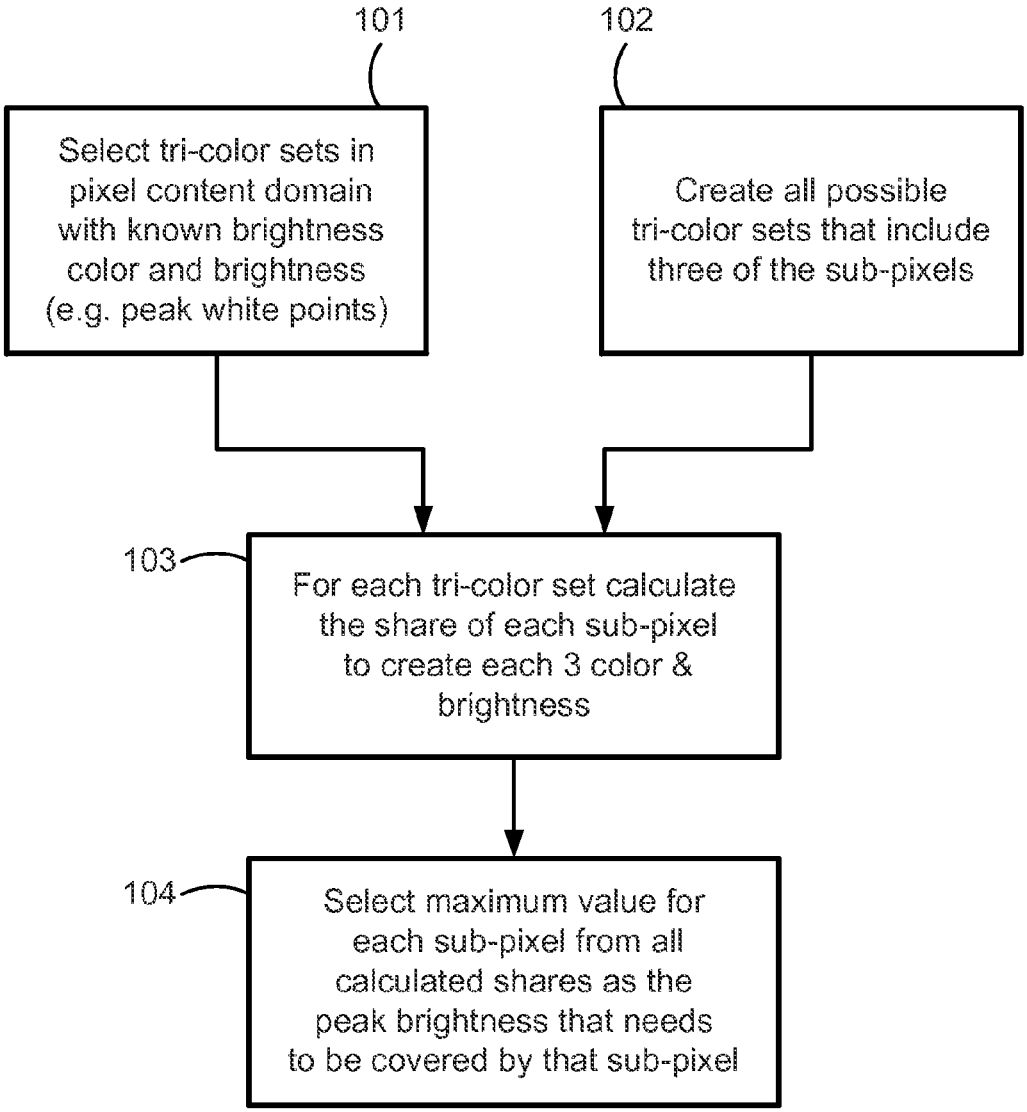
FIG. 1 is a flow chart of a routine for calculating the peak brightness of each sub-pixel in a display.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

Sub-Pixel Mapping

To improve color accuracy, power consumption or lifetime, OLED displays may have more than three primary sub-pixel colors. Therefore, proper color mapping is needed to provide continuous color space despite transitions between different color elements. Each pixel in such OLED displays consists of n sub-pixels $\{SP_1, SP_2, SP_3 \ldots SP_n\}$. The peak brightness that each sub-pixel should be able to create can be calculated, and used for the design of the display or for adjusting the gamma levels to required levels.

FIG. 1 is a flow chart of an exemplary routine for calculating the peak brightness for each sub-pixel. The first step 101 selects a plurality of reference points, with known color and brightness, such as peak white points, in the pixel content domain. Step 102 identifies all possible tri-color sets that include three of the sub-pixels. Then for each tri-color set, step 103 calculates the share of each sub-pixel to create the reference content point, i.e., the color and brightness. Step 104 selects the maximum value for each sub-pixel, from all the calculated shares, as the peak brightness that needs to be provided that sub-pixel.

The following is an example of calculating the brightness shares for a tri-color set of sub-pixels for a given white point and peak brightness:

```
function [Green Red Blue] = Color_Sharing_RGB (Rc,Gc,Bc,Wc)
%% Rc, Gc, Bc the color points of the tri-color sets
%% Wc is the white color point
 L = 100;      %% Peak Brightness
 %% calculating the brightness share
 WM=   [Wc(1)-1      0      Wc(1);
         0           1      0;
         Wc(2)       0      Wc(2) ];
 LM=   [-Wc(1)*L;
         L;
        -(Wc(2)-1)*L]:
 x = inv (WM):
 Wt = x* LM;
 Mt =  [Gc(1)/(Gc(2))          Rc(1)/(Rc(2))          Bc(1)/(Bc(2));
        1                      1                      1              ;
        (1-Gc(1)-Gc(2))/Gc(2)  (1-Rc(1)-Rc(2))/Rc(2)  (1-Bc(1)-
 Bc(2))/Bc(2)];
 x2 = inv (Mt);
 CR = x2 * Wt; %% CR is the brightness share of the trio-color set.
 Green = CR(1);
 Red = CR(2);
 Blue = CR(3);
end
```

Figure 2:
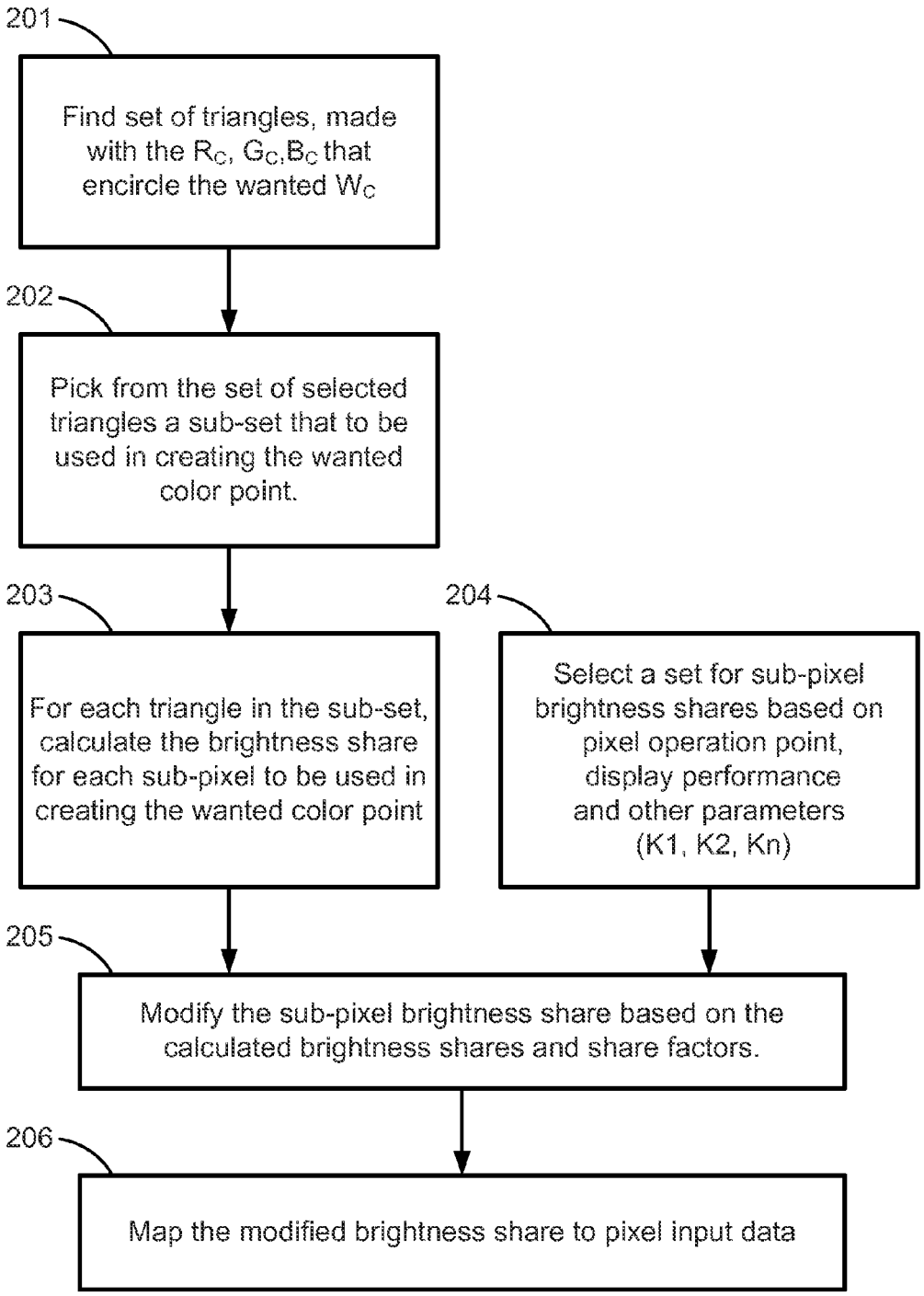
FIG. 2 is a flow chart of a routine for calculating the brightness shares for a tri-color set of sub-pixels.

FIG. 2 is a flow chart of an exemplary routine for calculating the brightness shares for the sub-pixels in a tri-color set. The first step 201 finds a set of triangles, made with the tri-color sub-pixels Rc, Gc, Bc that encircle a wanted white point Wc. Step 202 then selects a sub-set of those triangles to be used in creating the wanted color point Wc. Then for each triangle in the subset of triangles, step 203 calculates the brightness share for each sub-pixel in each triangle to create the wanted color point Wc. Step 204 selects a set of sub-pixel brightness shares based on a pixel operation point, display performance and other parameters (K1, K2 . . . Kn). Step 205 then uses the outputs of steps 203 and 204 to modify the sub-pixel brightness shares, based on the calculated brightness shares and share factors. Finally, step 206 maps the modified brightness shares to the pixel input data.

Different standards exist for characterizing colors. One example is the 1931 CIE standard, which characterizes colors by a luminance (brightness) parameter and two color coordinates x and y. The coordinates x and y specify a point on a CIE chromatacity diagram, which represents the mapping of human color perception in terms of the two CIE parameters x and y. The colors that can be matched by combining a given set of three primary colors, such as red, green and blue, are represented by a triangle that joins the coordinates for the three colors, within the CIE chromaticity diagram.

The following is an example of the brightness shares:
The parameters x and y for the color points of the tri-color set and intended white point are as follows:
Rc=[0.66 0.34]
Bc=[0.14 0.15]
Gc=[0.38 0.59]
Wc=[0.31 0.33]
[Green Red Blue]=Color_Sharing_RGB (Rc, Gc, Bc, Wc)
The color shares for the tri-color set are as follows:
Green=59.8237%
Red=17.7716%
Blue=22.4047%

Figure 3:
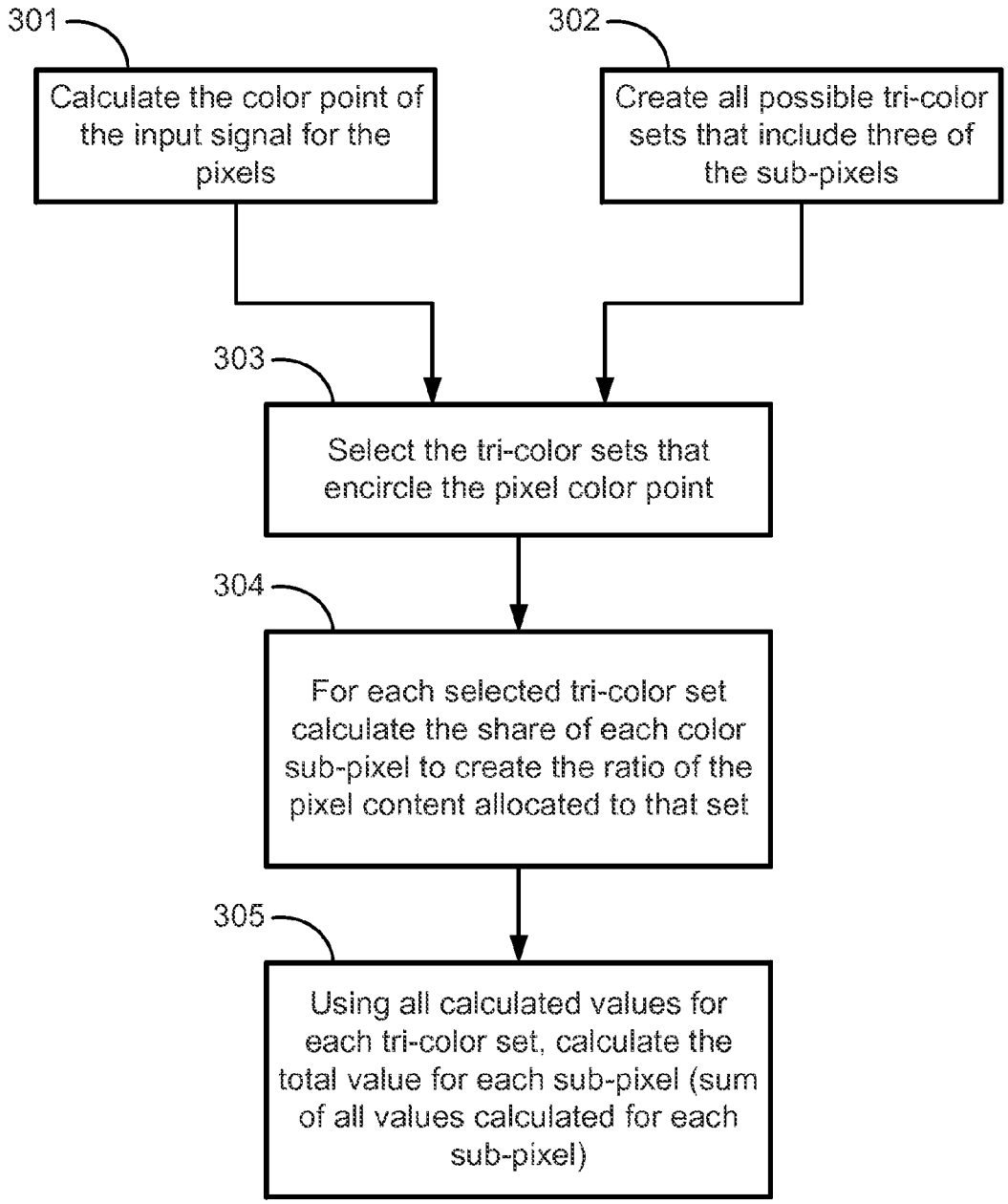
FIG. 3 is a flow chart of a routine for content mapping based on multiple sub-pixel colors in a display.

Each of the tri-color sets that encircles the pixel content will create a share of the pixel contents $K_1, K_2 \ldots K_m$, where the s are the shares of the respective sub-pixels in each tri-color set in the pixel content. The value of each sub-pixel in each of the tri-color sets is calculated considering the share of each tri-color. One such method is based on the function illustrated in FIG. 3, where step 301 calculates the color point of the input signal for the pixels, and step 302 creates all possible tri-color sets that include three of the sub-pixels. Step 303 then selects the tri-color sets that encircle the pixel color point, and step 304 calculates the share of each color sub-pixel to create the ratio of the pixel content allocated to each selected tri-color set. Step 305 uses all the calculated values for each tri-color set to calculate the total value for each sub-pixel, e.g., the sum of all values calculated for each sub-pixel.

Figure 4:
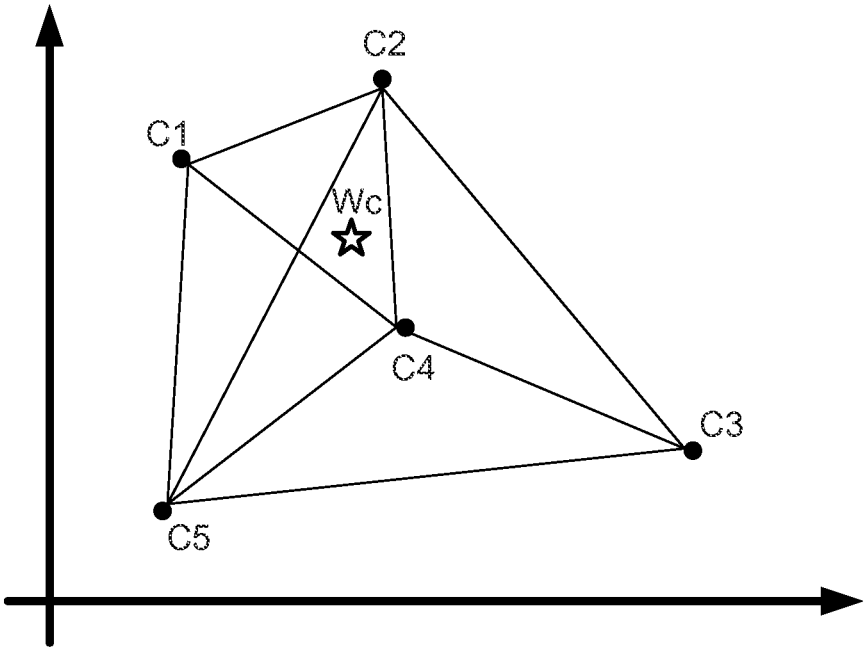
FIG. 4 is a diagram of a multiple sub-pixel display structure.

FIG. 4 shows an example of a display incorporating more than three sub-pixel colors (C1, C2, C3, C4, C5) and a wanted color point of Wc. As can be seen, the color point Wc can be created by any of {C1, C2, C4}, {C2, C4, C5}, {C2, C3, C5}, and {C1, C2, C3}. To create the wanted color Wc, one can use the algorithm described above. Also, one can use share factors to create the wanted color based on the sum of all the sets, such as: Wc=K1*{C1, C2, C4}+K2*{C2, C4, C5}+K3*{C2, C3, C5}+K4*{C1, C2, C3}, where the Ki's are the share factors for the tri-color set.

Dynamic Share Factor Adjustment

The share of each tri-color set can be varied based on the pixel content. For example, some sets provide better characteristics (e.g., uniformity) at some grayscales, whereas other sets can be better for other characteristics (e.g., power consumption) at different grayscales.

Figure 5:
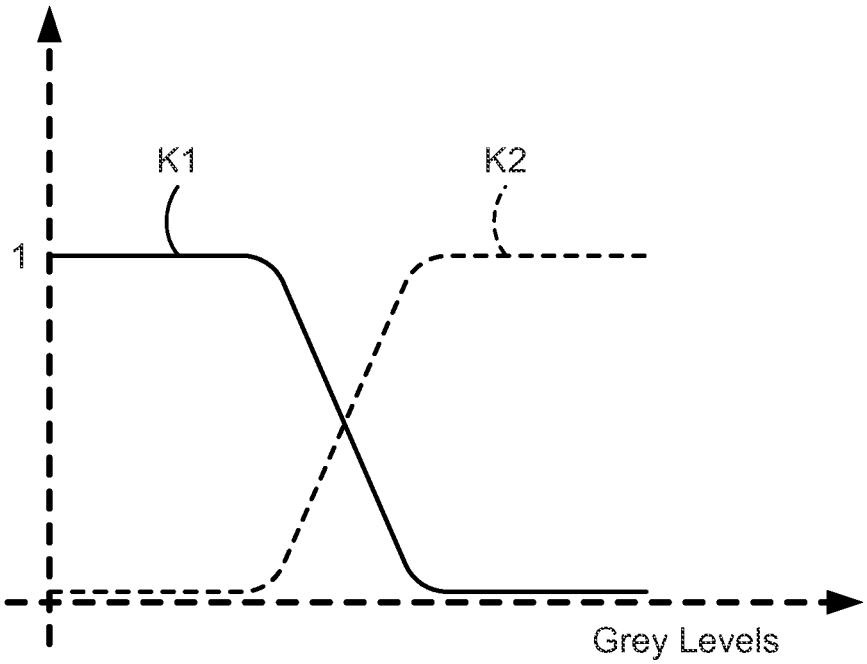
FIG. 5 is a graph of an example of share factors as a function of gray levels of a tricolor set with the lowest and highest efficiencies K1 and K2.

In one example, a display consists of Red, Green, Blue and White sub-pixels. The white sub-pixel is very efficient and so it can provide lower power consumption at high brightness. However, due to higher efficiency, the non-uniformity compensation does not work well at lower gray scales. In this case, low gray scales can be created with less efficient sub-pixels (e.g., red, green, and blue). Thus, the share factor can be a function of gray scales to take advantage of different set strengths at each gray level. For example, the share factor of a tri-color set with the lowest efficiency (K1) can be reduced at higher gray levels and increased at lower gray scales. And the share factor of the tri-color set with the highest efficiency (K2=1−K1) can be increased as the gray scale increases. Thus, the display can have both lower-power consumption at higher brightness levels and higher-uniformity at lower gray scales. This function can be step, a linear function or any other complex function. However, a smoothing function can be used at large transitions to avoid contours. FIG. 5 shows an example of the share factors for a two tri-color set system.

Locally Optimized Sub-Pixels

Due to the wide range of specifications for display performance, the sub-pixels will have an optimum operation point, and diverging from that point can affect one or two specifications. For example, to achieve low power consumption, one can use drive TFTs that are as large as possible to reduce the operating voltage. On the other hand, at low current levels, the TFTs will operate in a non-optimized regime of operation (e.g., sub-threshold). On the other hand, using small TFTs to improve the low grayscale performance will affect the power consumption and lifetime due to using large operating currents.

Figure 6:
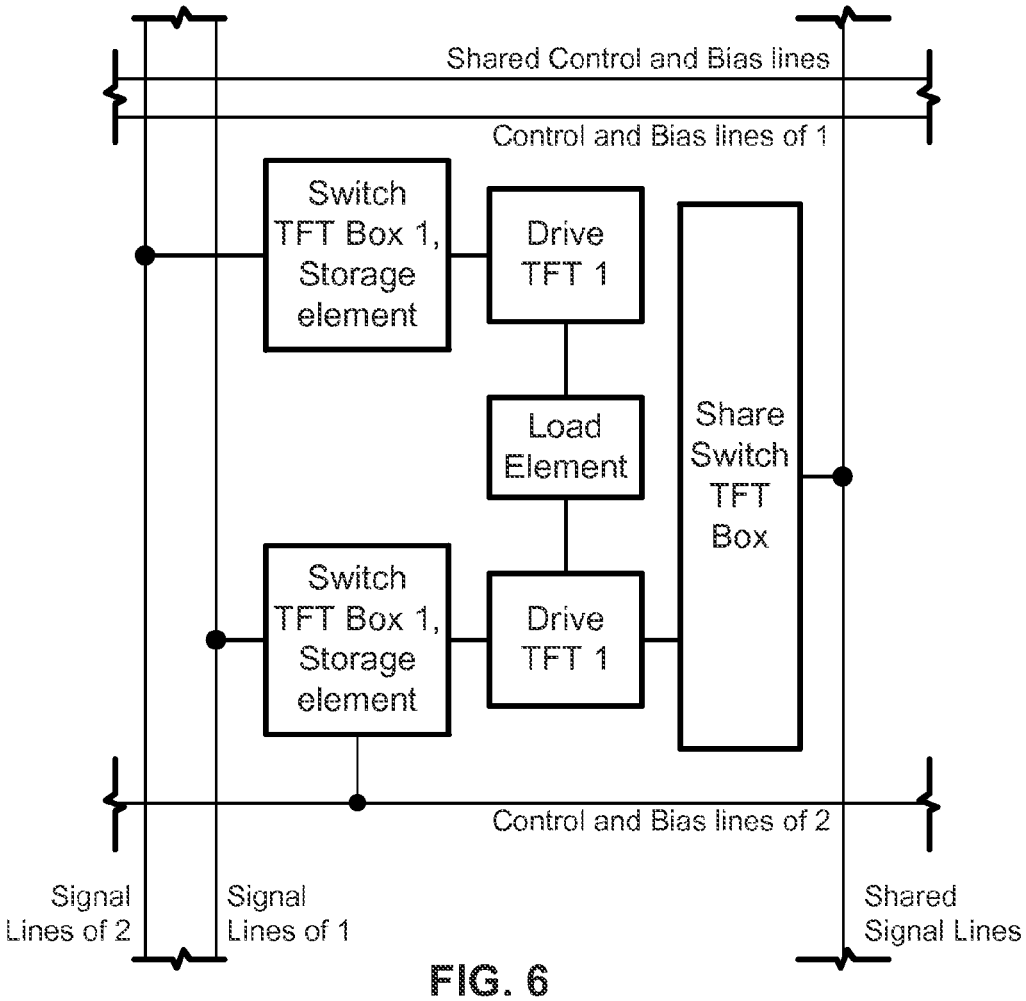
FIG. 6 is a block diagram of two locally optimized sub-pixels.

To address the difficulty in having a single sub-pixel optimized across all gray levels and operation ranges (e.g. different environmental conditions, brightness levels, etc), one can add sub-pixels optimized for different operating ranges. To optimize the operation of each sub-pixel for a specific gray-level set, one can change the component size or use a different pixel circuit for each locally optimized sub-pixel. Here, one can share all or some components of the sub-pixel (e.g., OLEDs, bias transistors, bias lines, and others). FIG. 6 illustrates an example using two locally optimized sub-pixels with some shared components and some dedicated components to each sub-pixel. Also, one can have two different load elements (e.g., OLEDs). In this example, the current required for either shared load or combined separate load elements is generated by both sub-pixels 1 and 2 where I1=A1*I and I2=A2*I (I is the total current required for the load, I1 is the current generated by sub-pixel #1, I2 is the current generated by sub-pixel #2, and A2=(1−A1)). Here, A1 and A2 are adjusted for different gray-scales (or operating conditions) to adjust the ratio of each sub-pixel in generating the current.

One can add sub-pixels optimized for different operating ranges. Here, one can share all or some components of the pixel (e.g., OLED, bias transistors, bias lines, and others).

Figure 7:
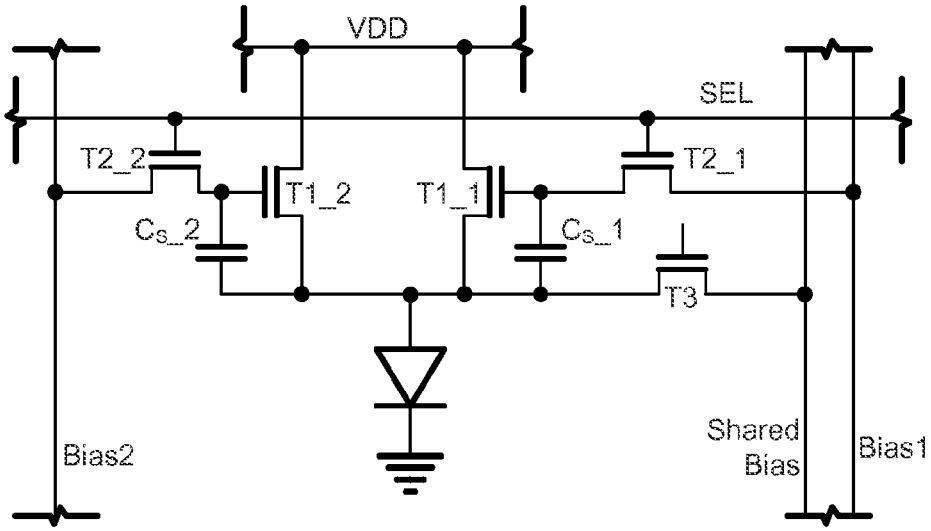
FIG. 7 is an electrical schematic diagram of a pixel circuit having two locally optimized sub-pixels.

FIG. 7 is a circuit diagram of an exemplary embodiment in which the drive TFT (T1), the programming switch TFT (T2), and the storage element ($C_S$) are optimized for each sub-pixel. Also, the TFT T3, the bias line, the select line (SEL) and the power line (VDD) are shared. In one case, different sizes of drive TFTs can be used to optimize the sub-pixels for different ranges of operation. For example, one can use a smaller drive TFT for one sub-pixel to be used for lower gray scales, and a larger drive TFT for the other sub-pixel to be used for higher gray scales.

Selecting each sub-pixel can be done either through a switch that activates or deactivates the sub-pixel, or through programming a sub-pixel with an off voltage to deactivate it.

The locally optimized sub-pixel method can be used for all sub-pixels or for only selected sub-pixels. For example, in the case of a RGBW sub-pixel structure, optimizing white sub-pixels across all gray levels is very difficult due to high OLED efficiency, while other sub-pixels can be optimized more easily. Thus, one can use a locally optimized sub-pixel method only for the white sub-pixel.

Gamma and Black Level Correction

A gamma calibration procedure ensures that colors displayed by a panel are accurate to the desired gamma curve, usually 2.2. The procedure has now been largely automated. The target white-point and curve are parameterized. The high level process is shown in FIGS. 8.A and 8B. This procedure assumes that initial uniformity compensation for the panel has already been applied.

Figure 8B:
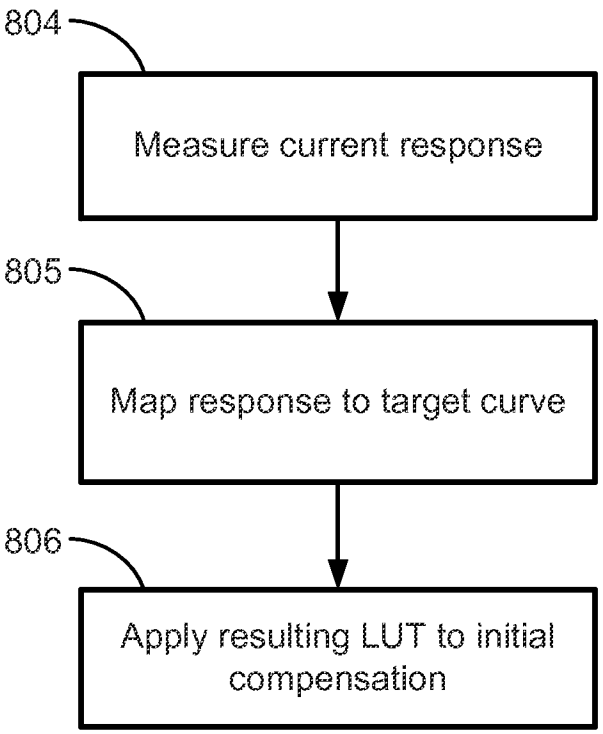
FIG. 8B is a flow chart of a procedure for using a measured current response to determine a lookup table for initial compensation of a display panel.
Figure 8A:
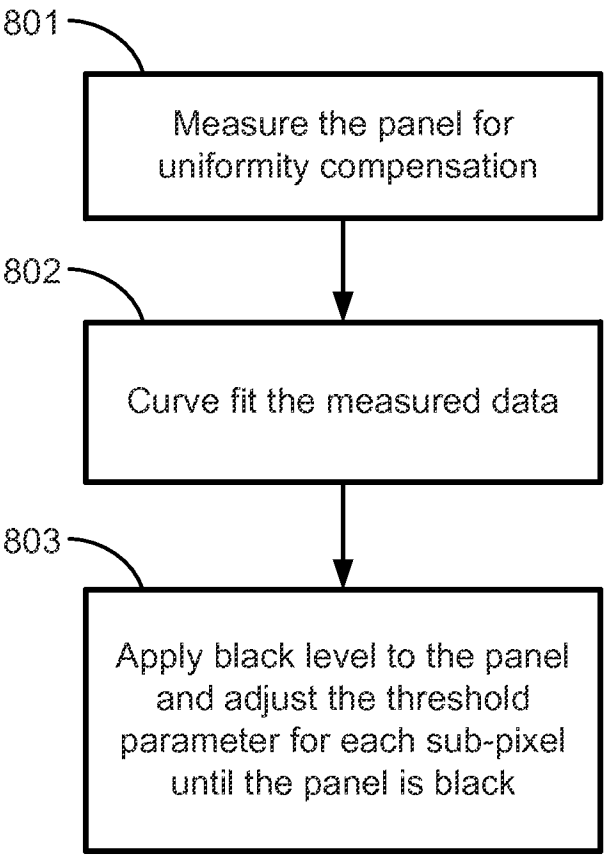
FIG. 8A is a flow chart of a procedure for adjusting the black level of a display panel based on panel uniformity measurements.

In the procedure of FIG. 8A, step 801 measures the display panel for uniformity compensation, and then curve fits the measured data. A black level is applied to the panel, and the threshold parameter for each sub-pixel is adjusted until the panel is black. In the procedure of FIG. 8B, the current response is measured at step 804, and then mapped to a target curve in step 805. Step 806 applies the resulting lookup table to initial compensation.

One advantage of emissive displays is deep black level. However, due to the non-linear behavior of the pixels and non-uniformity in the pixels, it is difficult to achieve black levels based on a continuous gamma curve. In one method, the worst case is chosen, and the off voltage is calculated based on that. Then that voltage, with some margin, is assigned to the black gray level, which generally puts the panel in a deep negative biasing condition. Since some backplanes are sensitive to negative bias conditions, the panel will develop image burn-in and non-uniformity over time.

To avoid that, the black level can be adjusted based on panel uniformity information. In this case, the uniformity of the pixel is measured at step 801 in FIG. 8A, and the threshold voltage (at which the pixel current is assumed to be off) is calculated at step 802. However, since simplified models are used to reduce the calculation and compensation complexity, the calculated threshold voltage will have some error. To assign a black voltage, the threshold voltage of the pixel is reduced at step 803 until the panel turns black. This can be done for each color individually, and the new modified threshold voltage is used for black voltage level.

In another aspect of this invention, a plurality of sensors are added to the panel, and the voltage of the black level is adjusted until all sensors provide zero readings. In this case, the initial start of the black level can be the calculated threshold voltage.

In another aspect of this invention, the black level for each sensor is adjusted individually, and a map of black level voltage is created based on each sensor data. This map can be created based on different methods of interpolation.

In another aspect of the invention, the black level has at least two values. One value is used for dark environments and another value is used for bright environments. Since the lower black level is not useful in bright environments, the pixel can be slightly on (at a level that is less than or similar to the reflection of the panel). Therefore, the pixel can avoid negative stress which is accelerated under higher brightness levels.

In another aspect of the invention, the black level has at least two values. One value is used when all the sup-pixels are off, and another value is used when at least one sub-pixel is ON. In this case, there can be a threshold for the brightness level of the ON sub-pixels required to switch to the second black level value for the OFF sub-pixels. For example, if the blue sub-pixel is ON and its brightness is higher than 1 nit, the other sub-pixels can be slightly ON (for example, less than 0.01 nit). In this case, the OFF sub-pixels can eliminate the negative bias stress under illumination.

In another aspect of the invention, the brightness of neighboring sub-pixel can be used to switch between different black level values. In this case, a weight can be assigned to the sub-pixels based on their distance from the OFF sub-pixels. In one example, this weight can be a fixed value, dropping to zero after a distance of a selected number of pixels. In another example, the weight can be a linear drop from one to zero. Also, different complex functions can be used for the weight function.

Measure Current Response

Figure 9:
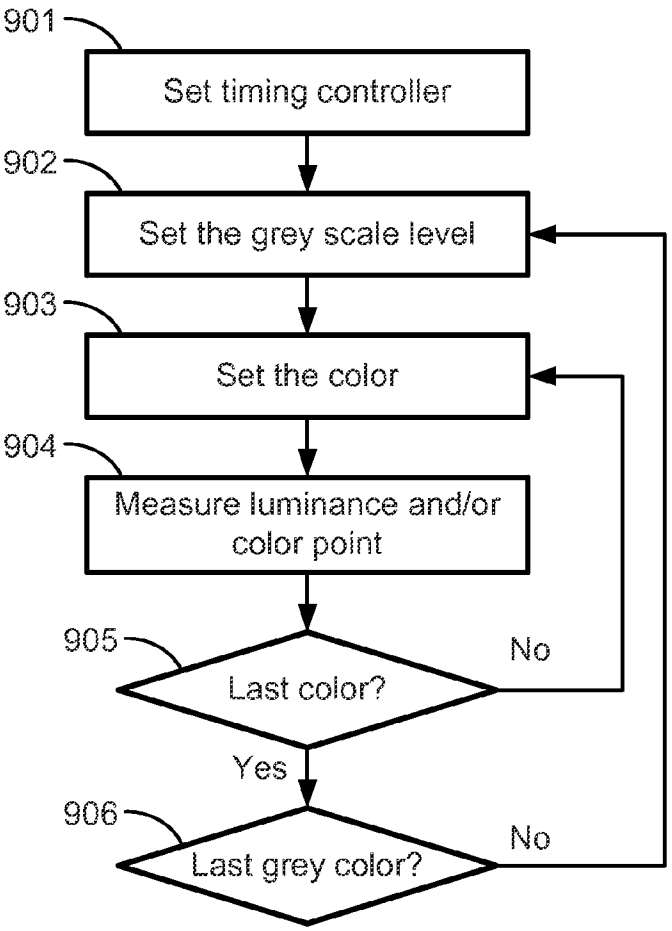
FIG. 9 is a flow chart of a current response measurement procedure.

The steps for a measure-current-response process are summarized in FIG. 9. The initial step 901 sets a timing controller, which ensures that measurements are taken with the display in the correct mode. Specifically, it ensures that the most recent compensation is being displayed on the panel. It also ensures that TFT and OLED corrections required before a gamma function is applied, are enabled while gamma correction and luminance correction are disabled. To avoid having to write the entire frame buffer to a single value, special flat-field registers can be implemented in the timing controller. When the timing controller is placed in this mode, step 902 writes the desired grey scale to the corresponding colors register, which is sufficient to display the desired color. Since characterizing the panel, especially at higher levels, with the entire panel on can lead to lower brightness and/or current limiting, step 903 sets only part of the panel to show the desired color level.

As pre-set list of grey scales is used to determine the measurement points that will be used. In one implementation, a list of 61 levels is used for characterization. These points are not linearly spaced; they are positioned more densely toward the low end of the curve, becoming sparser as the grey level increases. This is done to generally fit a 2.2 curve, not a linear one, and can be adjusted for other gamma curves. The list is ordered from the lowest target level (e.g., 0) to the highest target (e.g., 1023). Also, it can be in any other order. After applying each color level, the resulting luminance and/or color point (CIE-XY) are then recorded at step 904. Multiple measurements are taken, and error checking is employed to ensure the validity of the readings. For example, if the variation in the reading is too great, the setup is not working properly. Or if the reading shows an increasing or decreasing trend, it means the values have not settled yet. If luminance only is measured by a calibrated sensor, these readings are converted to luminance and color point data during processing based on a calibration curve of the sensor. The order of steps can be changed and still obtain valid results. Steps 903 and 904 are repeated until the last color is detected at step 905, after which steps 902-905 are repeated until the last gray color is detected at step 906.

Map Response to Target Curve

Figure 10:
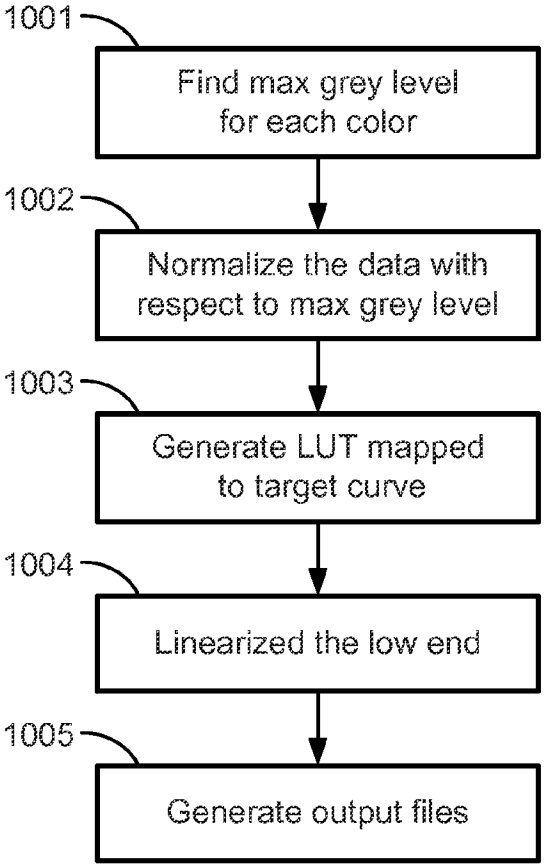
FIG. 10 is a flow chart of a map response to target curve procedure.

The target curve (e.g., the required gamma response) and white-point are specified as input parameters to the mapping function. The steps of this process are summarized in FIG. 10.

The first step is to load the measured data from the generated by the characterization procedure. If the data to be processed is from a calibrated sensor, one additional step is required. The calibration files for the sensor are used to convert the raw sensor readings to luminance and color point values.

Once the data is loaded, the target color point and peak luminance are used to calculate the peak target luminance for each color. Step 1001 finds the grey scale which results in this luminance, which allows the new maximum grey scale for each color to be determined. If any of the colors are not able to achieve the target, the target is adjusted such that the highest achievable brightness is targeted instead. Then the luminance readings are normalized to one, with respect to this new maximum grey scale, at step 1002.

This normalized data can now be used to map the measurements to the target curve, generating a look up table at step 1003. Linear interpolation is used to estimate the luminance between the measurement points. However, different known curve fitting processes can be used as well. The target curve is created by normalizing the target curve and finding the values for each of the points from lowest gray level (e.g., 0) to the highest gray level (e.g., 1023).

Some cases, like the standard sRGB curve, are actually piece wise. In these cases, a different component is used for each part of the curve. For example, for the standard sRGB, there is a linear component at the low end while the remainder of the curve is exponential. As a result, linearization is applied to the low end of the lookup table at step 1004. The point where linearization needs to be applied can be extracted from mapping the measured data to the standard. For example, the linearization can be applied to the first 100 grey scales where gray 100 represents the brightness points that the standard identifies and the change in the curve.

After the linearization is applied, all that remains is to write the resulting lookup table (LUT) to the appropriate output formats, at step 1005.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

The invention claimed is:

1. A display system comprising:

a display including a plurality of pixels, each pixel of the plurality of pixels including at least one optimized sub-pixel, each optimized sub-pixel comprising:

a plurality of components including at least one drive transistor, at least one storage element, and at least one light emitting element, arranged into at least two locally optimized sub-pixels, the at least two locally optimized sub-pixels sharing at least one shared component of the plurality of components, each locally optimized sub-pixel comprising at least one dedicated component of the plurality of components not shared with any other of the at least two locally optimized sub-pixels and each locally optimized sub-pixel performing differently from each other locally optimized sub-pixel for at least one range of operation; and a controller configured for controlling the operation of the at least two locally optimized sub-pixels based on a range of operation.

2. The display system of claim 1 wherein said at least one shared component comprises at least one of the at least one light emitting device, a bias transistor, a select line, and a bias line.

3. The display system of claim 1 wherein said at least one dedicated component of each of said at least two locally optimized sub-pixels comprises at least one of the at least one driving transistor, the at least one storage element, and the at least one light emitting device.

4. The display system of claim 1 wherein said range of operation comprises at least one of a range of environmental conditions and a range of brightness levels.

5. The display system of claim 1 wherein said controller is further configured for:

selecting and driving a first locally optimized sub-pixel of said at least two locally optimized sub-pixels while deactivating a second locally optimized sub-pixel of said at least two locally optimized sub-pixels for a first range of operation; and selecting and driving the second locally optimized sub-pixel while deactivating the first locally optimized sub-pixel for a second range of operation.

6. The display system of claim 5 wherein said first range of operation comprises a first range of brightness levels, and said second range of operation comprises a second range of brightness levels different from the first range of brightness levels.

7. The display system of claim 6 wherein said first range of brightness levels is less than said second range of brightness levels and wherein the at least one dedicated component of the first locally optimized sub-pixel comprises a drive transistor of a first size and the at least one dedicated component of the second locally optimized sub-pixel comprises a drive transistor of a second size greater than the first size.

8. The display system of claim 1 wherein said controller is further configured for:

controlling a first locally optimized sub-pixel of said at least two locally optimized sub-pixels while controlling a second locally optimized sub-pixel of said at least two locally optimized sub-pixels, the first locally optimized sub-pixel controlled independently from the controlling of the second locally optimized sub-pixel based on the range of operation.

9. The display system of claim 8 wherein said controller is further configured for: controlling the first and second locally optimized sub-pixel such that a ratio of currents generated by the first and second locally optimized sub-pixel for driving the at least one light emitting element varies according to varying ranges of operation.

10. The display system of claim 9 wherein the varying ranges of operation comprise varying ranges of brightness levels.

11. The display system of claim 1 wherein each pixel of the plurality of pixels includes a red sub-pixel, a green sub-pixel, a blue sub-pixel, and said at least one optimized sub-pixel comprises a white optimized sub-pixel.

12. A pixel of an array of pixels of a display, the pixel comprising:

at least one optimized sub-pixel, each optimized sub-pixel comprising:

a plurality of components including at least one drive transistor, at least one storage element, and at least one light emitting element, arranged into at least two locally optimized sub-pixels, the at least two locally optimized sub-pixels sharing at least one shared component of the plurality of components, each locally optimized sub-pixel comprising at least one dedicated component of the plurality of components not shared with any other of the at least two locally optimized sub-pixels and each locally optimized sub-pixel performing differently from each other locally optimized sub-pixel for at least one range of operation.

13. The pixel of claim 12 wherein said at least one shared component comprises at least one of the at least one light emitting device, a bias transistor, a select line, and a bias line.

14. The pixel of claim 12 wherein said at least one dedicated component of each of said at least two locally optimized sub-pixels comprises at least one of the at least one driving transistor, the at least one storage element, and the at least one light emitting device.

15. The pixel of claim 12 wherein said range of operation comprises at least one of a range of environmental conditions and a range of brightness levels.

16. The pixel of claim 12 wherein said at least one range of operation comprises a first range of brightness levels and a second range of brightness levels greater than said first range of brightness levels and wherein the at least one dedicated component of the first locally optimized sub-pixel comprises a drive transistor of a first size and the at least one dedicated component of the second optimized sub-pixel comprises a drive transistor of a second size greater than the first size.

17. The pixel of claim 12 further comprising a red sub-pixel, a green sub-pixel, a blue sub-pixel, wherein said at least one optimized sub-pixel comprises a white optimized sub-pixel.

18. A method for controlling a pixel of an array of pixels of a display, the pixel including at least one optimized sub-pixel, each optimized sub-pixel including a plurality of components including at least one drive transistor, at least one storage element, and at least one light emitting element, arranged into at least two locally optimized sub-pixels, the at least two locally optimized sub-pixels sharing at least one shared component of the plurality of components, each locally optimized sub-pixel comprising at least one dedicated component of the plurality of components not shared with any other of the at least two locally optimized sub-pixels and each locally optimized sub-pixel performing differently from each other locally optimized sub-pixel for at least one range of operation, said method comprising:

controlling a first locally optimized sub-pixel of said at least two locally optimized sub-pixels for a first range of operation; and controlling a second locally optimized sub-pixels of said at least two locally optimized sub-pixels for the first range of operation, the controlling of the second locally optimized sub-pixel independent from the controlling of the first locally optimized sub-pixel for the first range of operation.

19. The method of claim 18 wherein controlling the first locally optimized sub-pixel comprises selecting and driving the first locally optimized sub-pixel for the first range of operation and wherein controlling the second locally optimized sub-pixel comprises deactivating the second locally optimized sub-pixel for the first range of operation, the method further comprising:

selecting and driving the second locally optimized sub-pixel while deactivating the first locally optimized sub-pixel for a second range of operation.

20. The method of claim 19 wherein said first range of operation comprises a first range of brightness levels, and said second range of operation comprises a second range of brightness levels different from the first range of brightness levels.

21. The method of claim 20 wherein said first range of brightness levels is less than said second range of brightness levels and wherein the at least one dedicated component of the first locally optimized sub-pixel comprises a drive transistor of a first size and the at least one dedicated component of the second locally optimized sub-pixel comprises a drive transistor of a second size greater than the first size.

22. The method of claim 18 wherein the controlling of the first and second locally optimized sub-pixel is such that a ratio of the currents generated by the first and second locally optimized sub-pixel for driving the at least one light emitting element varies according to varying ranges of operation.

23. The method of claim 22 wherein the varying ranges of operation comprises varying ranges of brightness levels.

* * * * *